US010074358B1

(12) United States Patent
Valeri et al.

(10) Patent No.: US 10,074,358 B1
(45) Date of Patent: Sep. 11, 2018

(54) AUDIO CONTROL SYSTEMS AND METHODS FOR VEHICLES WITH VARIABLE COMPRESSION RATIO ENGINES

(71) Applicant: GM GLOBAL TECHNOLOGY OPERATIONS LLC, Detroit, MI (US)

(72) Inventors: Frank C. Valeri, Novi, MI (US); Timothy J. Roggenkamp, Brighton, MI (US); Thomas V. Timmons, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/697,876

(22) Filed: Sep. 7, 2017

(51) Int. Cl.
*G10K 15/02* (2006.01)
*F02D 15/02* (2006.01)

(52) U.S. Cl.
CPC ..... *G10K 15/02* (2013.01); *F02D 15/02* (2013.01)

(58) Field of Classification Search
CPC ..... G10K 15/02; F02D 15/02
USPC ..... 381/86
See application file for complete search history.

(56) References Cited

U.S. PATENT DOCUMENTS 7,876,913 B2 * 1/2011 Kobayashi ..... G10K 15/02 381/71.1
8,041,053 B2 * 10/2011 Kobayashi ..... G10H 1/14 381/86
8,938,079 B2 1/2015 Valeri et al.
9,401,683 B2 * 7/2016 Inoue ..... H03G 3/00
9,437,185 B2 * 9/2016 Inoue ..... G10K 15/02
9,495,953 B2 * 11/2016 Hera ..... H04R 1/22
9,908,466 B2 * 3/2018 Hera ..... B60Q 9/00
2011/0216916 A1 * 9/2011 Hera ..... G10K 15/02 381/86
2012/0130580 A1 * 5/2012 Omote ..... B60Q 5/008 701/22
2012/0177214 A1 * 7/2012 Hera ..... G10K 15/02 381/73.1
2014/0016792 A1 * 1/2014 Christoph ..... G10L 19/06 381/61
2015/0197195 A1 * 7/2015 Hera ..... B60Q 9/00 381/86
2015/0364125 A1 * 12/2015 Park ..... G10K 15/02 701/36

(Continued)

*Primary Examiner* — David Ton

(57) ABSTRACT

A sound control module is configured to determine N magnitudes for outputting a predetermined engine sound at N predetermined harmonics of a base frequency, respectively, where N is an integer greater than one. An adjustment module is configured to determine N magnitude adjustments for the N predetermined harmonics, respectively, based on a position of a compression ratio (CR) actuator configured to vary a CR of an engine. The sound control module is further configured to determine N adjusted magnitudes for the N predetermined harmonics based on: the N magnitudes for the N predetermined harmonics, respectively; and the N magnitude adjustments for the N predetermined harmonics, respectively. An audio driver module is configured to apply power to at least one speaker of the vehicle and output the predetermined engine sound based on the N adjusted magnitudes at N frequencies, respectively, corresponding to the N predetermined harmonics of the base frequency.

20 Claims, 3 Drawing Sheets

(56) References Cited

U.S. PATENT DOCUMENTS

| | | | | |
|---|---|---|---|---|
| 2016/0101726 | A1* | 4/2016 | Chang | G10K 15/02 381/86 |
| 2016/0144782 | A1* | 5/2016 | Jo | B60Q 9/00 381/86 |
| 2016/0192095 | A1* | 6/2016 | Marcelli | F01N 9/00 700/94 |
| 2017/0078822 | A1* | 3/2017 | Barlow, Jr. | H04S 7/307 |

* cited by examiner

AUDIO CONTROL SYSTEMS AND METHODS FOR VEHICLES WITH VARIABLE COMPRESSION RATIO ENGINES

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to audio systems of vehicles and more particularly to systems and methods for outputting engine sound via audio systems of vehicles based on compression ratio of a variable compression ratio engine.

Some vehicles include conventional powertrains having an internal combustion engine and a drivetrain that normally emit sounds during vehicle operation. Many consumers have come to rely on these normal sounds as a sign of proper vehicle function. Changes in these normal sounds may indicate, to certain consumers, that the internal combustion engine and/or the drivetrain may be functioning differently than expected.

Some consumers may have expectations as to what the normal sounds of different types of vehicle should be. For example, a consumer may expect certain sounds from "high performance" vehicles, while some sounds may not be expected from other types of vehicles. An absence of expected sounds may detract from a user's enjoyment of a vehicle. Presence of unexpected vehicle sounds, such as sound produced by one or more powertrain components, may also detract from a user's enjoyment of a vehicle.

SUMMARY

In a feature, an audio control system of a vehicle includes a sound control module configured to determine N magnitudes for outputting a predetermined engine sound at N predetermined harmonics of a base frequency, respectively, where N is an integer greater than one. An adjustment module is configured to determine N magnitude adjustments for the N predetermined harmonics, respectively, based on a position of a compression ratio (CR) actuator configured to vary a CR of an engine. The sound control module is further configured to determine N adjusted magnitudes for the N predetermined harmonics based on: the N magnitudes for the N predetermined harmonics, respectively; and the N magnitude adjustments for the N predetermined harmonics, respectively. An audio driver module is configured to apply power to at least one speaker of the vehicle and output the predetermined engine sound based on the N adjusted magnitudes at N frequencies, respectively, corresponding to the N predetermined harmonics of the base frequency.

In further features, the sound control module is configured to: based on the position of the CR actuator being a first predetermined position, set the N magnitude adjustments for the N predetermined harmonics to a first set of N predetermined magnitude adjustments for the N predetermined harmonics, the first set being associated with the first predetermined position; and based on the position of the CR actuator being a second predetermined position, set the N magnitude adjustments for the N predetermined harmonics to a second set of N predetermined magnitude adjustments for the N predetermined harmonics, the second set being associated with the second predetermined position. The first predetermined position is different than the second predetermined position.

In further features, the sound control module is configured to: based on the position of the CR actuator being less than a predetermined position, set the N magnitude adjustments for the N predetermined harmonics to a first set of N predetermined magnitude adjustments for the N predetermined harmonics; and based on the position of the CR actuator being greater than the predetermined position, set the N magnitude adjustments for the N predetermined harmonics to a second set of N predetermined magnitude adjustments for N predetermined harmonics.

In further features, at least one of: the first set of N predetermined magnitude adjustments includes a magnitude adjustment for at least one predetermined half order harmonic of the base frequency; and the second set of N predetermined magnitude adjustments includes a magnitude adjustment for at least one predetermined half order harmonic of the base frequency.

In further features, a vehicle system includes the audio control system and the compression ratio (CR) actuator. The CR actuator is configured to vary at least one of: a top most position of a piston within a cylinder; and a bottom most position of the piston within the cylinder.

In further features, the sound control module is configured to determine the N magnitudes for the N predetermined harmonics, respectively, based on an engine torque output.

In further features, the sound control module is configured to determine the N magnitudes for the N predetermined harmonics, respectively, based on the engine torque output using a lookup table. The lookup table includes sets of magnitudes for the N predetermined harmonics, respectively, indexed by engine torque output.

In further features, the sound control module is configured to set the N adjusted magnitudes for the N predetermined harmonics based on sums of: the N magnitudes for the N predetermined harmonics, respectively; and the N magnitude adjustments for the N predetermined harmonics, respectively.

In further features, the sound control module is configured to set the N adjusted magnitudes for the N predetermined harmonics based on mathematical products of: the N magnitudes for the N predetermined harmonics, respectively; and the N magnitude adjustments for the N predetermined harmonics, respectively.

In further features, the N predetermined harmonics include at least one predetermined half order harmonic of the base frequency.

In further features, the base frequency is a predetermined fundamental frequency of the engine.

In further features, the base frequency corresponds to a rotational speed of the engine.

In further features, the base frequency does not correspond to a rotational speed of the engine and is not a predetermined fundamental frequency of the engine.

In further features: a second adjustment module is configured to determine N second magnitude adjustments for the N predetermined harmonics, respectively, based on a driver selected mode of operation; and the sound control module is configured to determine the N adjusted magnitudes for the N predetermined harmonics based on: the N magnitudes for the N predetermined harmonics, respectively; the N second magnitudes for the N predetermined harmonics, respectively; and the N magnitude adjustments for the N predetermined harmonics, respectively.

In further features, the second adjustment module is configured to: when the driver selected mode is a first mode, set the N second magnitude adjustments for the N predetermined harmonics to a first set of N predetermined second magnitude adjustments for the N predetermined harmonics; and when the driver selected mode is a second mode, set the N second magnitude adjustments for the N predetermined harmonics to a second set of N second predetermined magnitude adjustments for the N predetermined harmonics.

In a feature, an audio control method for a vehicle includes: determining N magnitudes for outputting a predetermined engine sound at N predetermined harmonics of a base frequency, respectively, where N is an integer greater than one; determining N magnitude adjustments for the N predetermined harmonics, respectively, based on a position of a compression ratio (CR) actuator configured to vary a CR of an engine; determining N adjusted magnitudes for the N predetermined harmonics based on: the N magnitudes for the N predetermined harmonics, respectively; and the N magnitude adjustments for the N predetermined harmonics, respectively; and applying power to at least one speaker of the vehicle and outputting the predetermined engine sound based on the N adjusted magnitudes at N frequencies, respectively, corresponding to the N predetermined harmonics of the base frequency.

In further features, determining N magnitude adjustments for the N predetermined harmonics includes: based on the position of the CR actuator being a first predetermined position, setting the N magnitude adjustments for the N predetermined harmonics to a first set of N predetermined magnitude adjustments for the N predetermined harmonics, the first set being associated with the first predetermined position; and based on the position of the CR actuator being a second predetermined position, setting the N magnitude adjustments for the N predetermined harmonics to a second set of N predetermined magnitude adjustments for the N predetermined harmonics, the second set being associated with the second predetermined position, where the first predetermined position is different than the second predetermined position.

In further features, determining N magnitude adjustments for the N predetermined harmonics includes: based on the position of the CR actuator being less than a predetermined position, setting the N magnitude adjustments for the N predetermined harmonics to a first set of N predetermined magnitude adjustments for the N predetermined harmonics; and based on the position of the CR actuator being greater than the predetermined position, setting the N magnitude adjustments for the N predetermined harmonics to a second set of N predetermined magnitude adjustments for N predetermined harmonics.

In further features, at least one of: the first set of N predetermined magnitude adjustments includes a magnitude adjustment for at least one predetermined half order harmonic of the base frequency; and the second set of N predetermined magnitude adjustments includes a magnitude adjustment for at least one predetermined half order harmonic of the base frequency.

In further features, the audio control method further includes adjusting the position of the CR actuator, thereby varying at least one of: a top most position of a piston within a cylinder; and a bottom most position of the piston within the cylinder.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Internal combustion engines of vehicles combust air and fuel within cylinders. An engine control module (ECM) controls engine actuators, for example, based on a driver torque request. A vehicle may also include one or more motor generator units (MGUs) that can be used to perform different functions at different times. For example, an MGU can be used (i) to output torque to a powertrain of the vehicle and (ii) to impose a load on the powertrain of the vehicle to convert mechanical energy into electrical energy, for example, for regeneration.

Some engines include actuators that change a compression ratio of the engine. More specifically, some engines include actuators that adjust travel of pistons of the engine and change volumes of the cylinders of the engine. Different engine sounds and different noise and vibration characteristics may be experienced, however, with different compression ratios.

An audio control module outputs engine sound via one or more speakers of the vehicle. More specifically, the audio control module sets frequencies and magnitudes for outputting an engine sound based on engine speed and engine torque.

As discussed above, however, engine sound and noise and vibration may vary as compression ratio changes. The audio control module therefore selectively adjusts one or more of the frequencies and/or magnitudes for outputting the engine sound based on the compression ratio. In this way, the audio control module provides more consistent engine sound and noise and vibration within the passenger cabin despite the use of various different compression ratios. This may enhance the experience of users within the passenger cabin of the vehicle.

Figure 1:
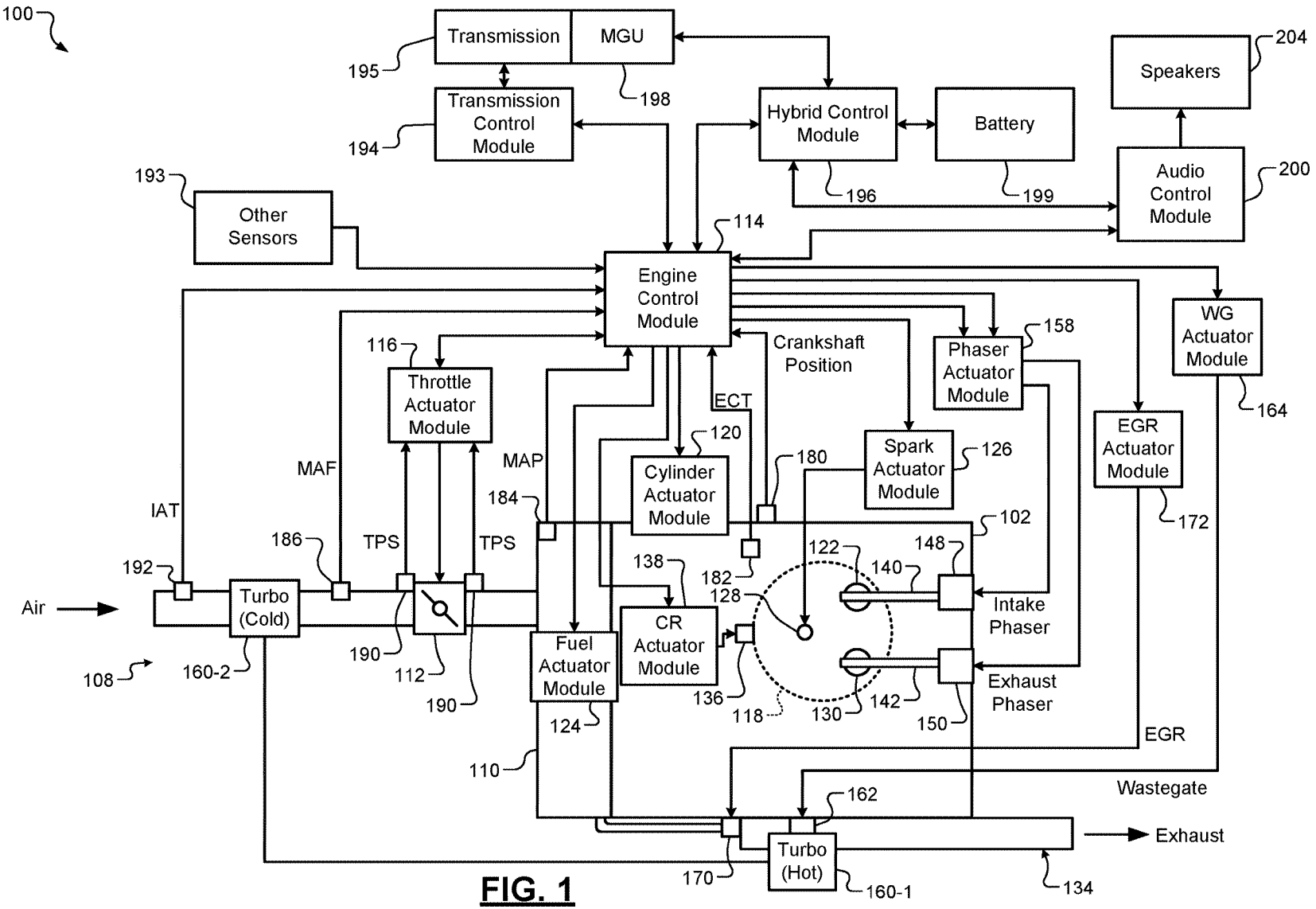
FIG. 1 is a functional block diagram including an example powertrain system of a vehicle including an engine having variable displacement.

Referring now to FIG. 1, a functional block diagram of an example powertrain system 100 is presented. The powertrain system 100 of a vehicle includes an engine 102 that combusts an air/fuel mixture to produce torque. The vehicle may be non-autonomous or autonomous.

Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle or another suitable engine cycle. The four strokes of a four-stroke cycle, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture within the cylinder 118. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may disable provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time when the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

A (actual) compression ratio (CR) corresponds to a ratio of: the volume of the cylinder 118 when the piston is in the BDC position (where the volume of the cylinder 118 is a maximum value); to the volume of the cylinder 118 when the piston is in the TDC position (where the volume of the cylinder 118 is a minimum value). A CR actuator 136 of the cylinder 118 actuates and adjusts the CR of the cylinder 118. For example, the CR actuator 136 may actuate and adjust the BDC position of the piston and/or the TDC position of the piston. The CR actuator 136 may, for example, move a connecting rod that connects the piston with the crankshaft to adjust the CR. By changing the BDC position of the piston and/or the TDC position of the piston, the CR actuator 136 changes the (actual) CR. A CR actuator module 138 actuates the CR actuator 136 based on signals from the ECM 114.

One CR actuator may be provided with each cylinder. The CR actuator module 138 may actuate the CR actuators individually based on respective signals for the CR actuators from the ECM 114, may actuate one or more subsets of the CR actuators based on respective signals for the subset(s) from the ECM 114, or may actuate all of the CR actuators based on signals for all of the CR actuators from the ECM 114.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented. While separate intake and exhaust camshafts are shown, one camshaft having lobes for both the intake and exhaust valves may be used. Differently than the CR actuators, intake and/or exhaust valve timing may be adjusted to vary effective CR by varying airflow into the cylinders.

The cylinder actuator module 120 may deactivate the cylinder 118 by disabling opening of the intake valve 122 and/or the exhaust valve 130. The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. In various implementations, cam phasing may be omitted. Variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine 102 may include zero, one, or more than one boost device that provides pressurized air to the intake manifold 110. For example, FIG. 1 shows a turbocharger including a turbocharger turbine 160-1 that is driven by exhaust gases flowing through the exhaust system 134. A supercharger is another type of boost device.

The turbocharger also includes a turbocharger compressor 160-2 that is driven by the turbocharger turbine 160-1 and that compresses air leading into the throttle valve 112. A wastegate 162 controls exhaust flow through and bypassing the turbocharger turbine 160-1. Wastegates can also be referred to as (turbocharger) turbine bypass valves. The wastegate 162 may allow exhaust to bypass the turbocharger turbine 160-1 to reduce intake air compression provided by the turbocharger. The ECM 114 may control the turbocharger via a wastegate actuator module 164. The wastegate actuator module 164 may modulate the boost of the turbocharger by controlling an opening of the wastegate 162.

A cooler (e.g., a charge air cooler or an intercooler) may dissipate some of the heat contained in the compressed air charge, which may be generated as the air is compressed. Although shown separated for purposes of illustration, the turbocharger turbine 160-1 and the turbocharger compressor 160-2 may be mechanically linked to each other, placing intake air in close proximity to hot exhaust. The compressed air charge may absorb heat from components of the exhaust system 134.

The engine 102 may include an exhaust gas recirculation (EGR) valve 170, which selectively redirects exhaust gas back to the intake manifold 110. The EGR valve 170 may receive exhaust gas from upstream of the turbocharger turbine 160-1 in the exhaust system 134. The EGR valve 170 may be controlled by an EGR actuator module 172.

Crankshaft position may be measured using a crankshaft position sensor 180. An engine speed may be determined based on the crankshaft position measured using the crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192.

One or more other sensors 193 may also be implemented. For example, an exhaust temperature sensor may measure a temperature of exhaust within an exhaust manifold that receives exhaust gas output from the cylinders. The other sensors 193 include an accelerator pedal position (APP) sensor, a brake pedal position (BPP) sensor, may include a clutch pedal position (CPP) sensor (e.g., in the case of a manual transmission), and may include one or more other types of sensors. An APP sensor measures a position of an accelerator pedal within a passenger cabin of the vehicle. A BPP sensor measures a position of a brake pedal within a passenger cabin of the vehicle. A CPP sensor measures a position of a clutch pedal within the passenger cabin of the vehicle. The ECM 114 may use signals from the sensors to make control decisions for the engine 102.

The ECM 114 may communicate with a transmission control module 194, for example, to coordinate engine operation with gear shifts in a transmission 195. The ECM 114 may communicate with a hybrid control module 196, for example, to coordinate operation of the engine 102 and a motor generator unit (MGU) 198. While the example of one MGU is provided, multiple MGUs and/or electric motors may be implemented. The terms MGU and electric motor may be interchangeable herein. In various implementations, various functions of the ECM 114, the transmission control module 194, and the hybrid control module 196 may be integrated into one or more modules.

Each system of the engine 102 that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the CR actuator module 138, the phaser actuator module 158, the wastegate actuator module 164, and the EGR actuator module 172. For these engine actuators, the actuator values may correspond to a cylinder activation/deactivation sequence, fueling rate, CR (or CR actuator position), intake and exhaust cam phaser angles, target wastegate opening, and EGR valve opening, respectively.

The ECM 114 may control the actuator values in order to cause the engine 102 to output torque based on a torque request. The ECM 114 may determine the torque request, for example, based on one or more driver inputs, such as an APP, a BPP, a CPP, and/or one or more other suitable inputs. The ECM 114 may determine the torque request, for example, using one or more functions or lookup tables that relate the input(s) to torque requests.

Under some circumstances, the hybrid control module 196 controls the MGU 198 to output torque, for example, to supplement engine torque output. The hybrid control module 196 applies electrical power from a battery 199 to the MGU 198 to cause the MGU 198 to output positive torque. While the example of the battery 199 is provided, more than one battery may be used to supply power to the MGU 198. The MGU 198 may output torque, for example, to the engine 102, to an input shaft of the transmission 195, to an output shaft of the transmission 195, or to another torque transfer device of the powertrain of the vehicle. The battery 199 may be dedicated for the MGU 198 and one or more other batteries may supply power for other vehicle functions.

Under other circumstances, the hybrid control module 196 may control the MGU 198 to convert mechanical energy of the vehicle into electrical energy. The hybrid control module 196 may control the MGU 198 to convert mechanical energy into electrical energy, for example, to recharge the battery 199. This may be referred to as regeneration.

The vehicle also includes an audio control module 200 that controls sound output via speakers 204. The speakers 204 may be located and output sound to within the passenger cabin of the vehicle. However, one or more of the speakers 204 may be implemented at another location, such as in the exhaust system 134. The audio control module 200 may control the speakers 204 to output sound based on received amplitude modulation (AM) signals, received frequency modulation (FM) signals, received satellite signals, and other types of audio signals. The audio control module 200 may be implemented, for example, with an infotainment system.

Under some circumstances, the audio control module 200 additionally or alternatively control the sound output via the speakers 204 to generate engine sound. The audio control module 200 may generate engine sound via the speakers 204, for example, to enhance and/or cancel various components of sound output by the engine 102.

The audio control module 200 may receive parameters from the ECM 114, the hybrid control module 196, the transmission control module 194, and/or one or more other control modules of the vehicle. The audio control module 200 may receive parameters from other modules, for example, via a car area network (CAN) bus or another type of network. As discussed further below, the audio control module 200 may determine when and the extent to which to output engine sound based on one or more of the received parameters.

Figure 2:
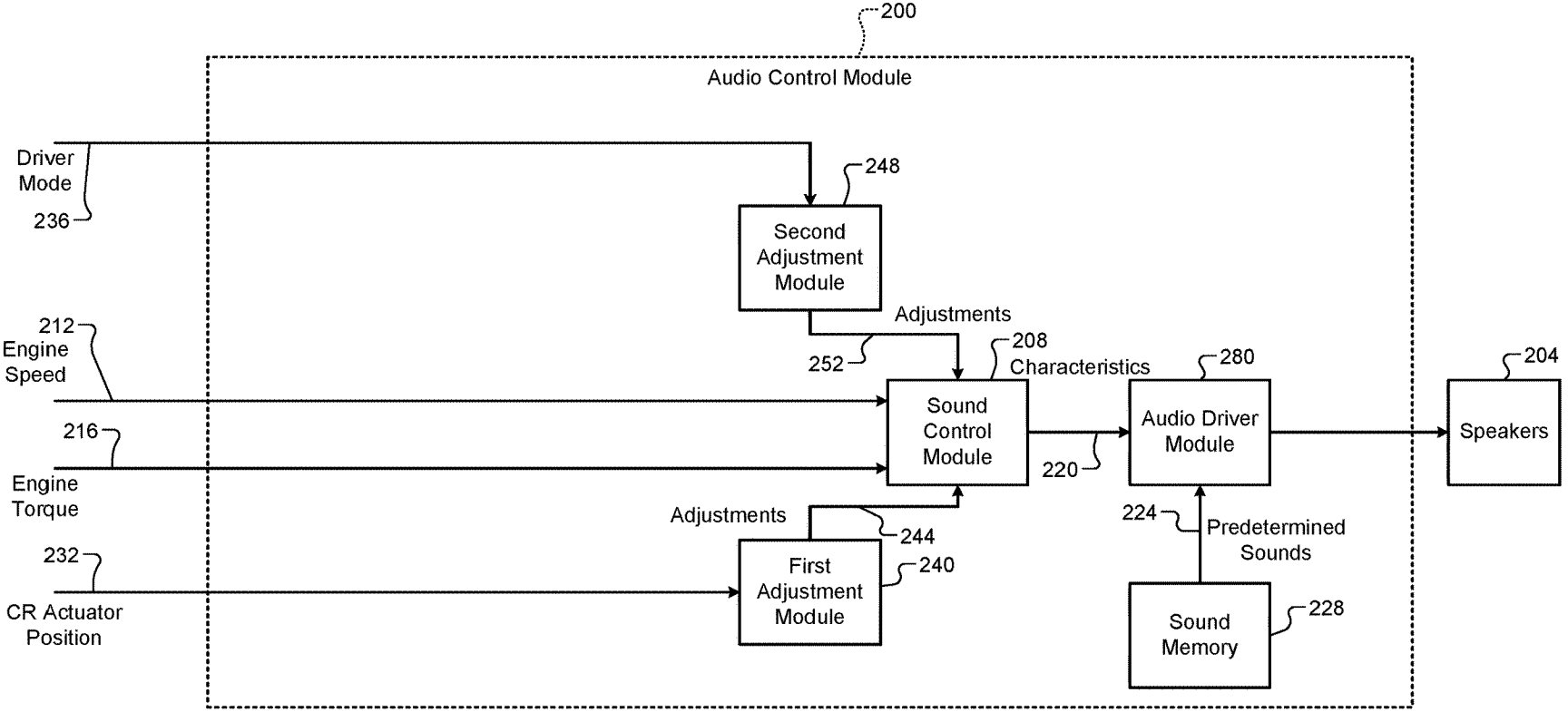
FIG. 2 is a functional block diagram including an example audio control module and speakers.

FIG. 2 is a functional block diagram of an example audio system including the audio control module 200 and the speakers 204. The speakers 204 output sound within the passenger cabin of the vehicle and/or at one or more other locations of the vehicle, such as at the exhaust system 134 of the vehicle.

A sound control module 208 determines how to output engine sound via the speakers 204 based on at least one of an engine speed 212 and an engine torque 216. More specifically, the sound control module 208 sets characteristics 220 of one or more predetermined engine sounds 224 to output via the speakers 204 based on at least one of the engine speed 212 and the engine torque 216.

The engine speed 212 may be measured using an engine speed sensor or determined (e.g., by an engine speed module of the ECM 114) based on changes in crankshaft position measured using the crankshaft position sensor 180 over a period between crankshaft positions. The engine torque 216 may be measured using a torque sensor or determined (e.g., by a torque estimation module of the ECM 114) based on one or more parameters using one or more equations and/or lookup tables that relate the parameter(s) to engine torque. As an example, the torque estimation module may determine the engine torque 216 using a torque relationship such as $$T=f(\mathrm{APC},S,I,E,\mathrm{AF},\mathrm{OT},\#),$$

where torque (T) is a function of air per cylinder (APC), spark advance (S), intake cam phaser position (I), exhaust cam phaser position (E), air/fuel ratio (AF), oil temperature (OT), and number of activated cylinders (#). Additional variables may also be accounted for, such as the degree of opening of an exhaust gas recirculation (EGR) valve. This relationship may be modeled by an equation and/or may be stored as a lookup table. The torque estimation module may determine the APC based on measured MAF and the engine speed 212, for example, using one or more equations and/or lookup tables that relate MAF and engine speed to APC.

The predetermined engine sounds 224 may include one or more predetermined engine sounds to be output at predetermined orders of a frequency (e.g., the predetermined fundamental frequency (e.g., in Hertz) of the engine 102, a frequency corresponding to the engine speed 212, or a frequency not corresponding to the engine speed 212).

Predetermined engine sounds output at orders of frequencies not corresponding to the engine speed 212 may be output, for example, to cancel and/or attenuate various sounds and/or for one or more other purposes. Predetermined engine sounds output at or based on orders of frequencies corresponding to the engine speed 212 may be output, for example, to enhance or attenuate engine sound at those orders. Predetermined engine sounds output at or based on orders of the predetermined fundamental frequency of the engine 102 may be output, for example, to enhance or attenuate sound at those orders.

The characteristics 220 at a given time may include, for example, magnitudes (e.g., in dB) for each of the predetermined orders, respectively, of a base frequency (e.g., the predetermined fundamental frequency, a frequency corresponding to the engine speed 212, or a frequency not corresponding to the engine speed 212) at which to output a given one of the predetermined engine sounds 224. While the example of one of the predetermined engine sounds will be discussed, the characteristics 220 may include the same information for multiple different predetermined sounds. Also, while the example of one base frequency will be discussed, the characteristics 220 may include the same information for multiple different base frequencies. For example only, the predetermined orders may include, but are not limited to, 0.5, 1, 1.5, 2, 2.5, 3, 3.5, 4, 4.5, 5, 5.5, 6, 6.5, 7, 7.5, and $8^{th}$ orders of the base frequency. The predetermined orders, however, may include one or more other orders. Sound files of the predetermined engine sound(s) 224 (or tones) are stored in memory, such as in sound memory 228.

The sound control module 208 determines base magnitudes for outputting the one of the predetermined engine sounds 224 at the predetermined orders of the base frequency based on the engine torque 216. For example, the sound control module 208 determines the base magnitudes for outputting the one of the predetermined engine sounds 224 using a lookup table of base magnitudes for outputting the one of the predetermined engine sounds 224 at the predetermined orders indexed by engine torque. An example of one row of such a lookup table for one torque is provided below merely as an illustrative aid.

| T | O→ | | | | | | | | | | | |
|---|---|---|---|---|---|---|---|---|---|---|---|---|
| ↓ | 0.5 | 1.0 | 1.5 | 2.0 | 2.5 | 3.0 | 3.5 | 4.0 | 4.5 | 5.0 | 5.5 | . . . |
| T | BM0.5 | BM1 | BM1.5 | BM2 | BM2.5 | BM3 | BM3.5 | BM4 | BM4.5 | BM5 | BM5.5 | . . . |

The top row lists predetermined orders (O) of the base frequency (e.g., the predetermined fundamental frequency of the engine 102, a frequency corresponding to the engine speed 212, or a frequency not corresponding to the engine speed 212). For example, 0.5 corresponds to the 0.5th order of the base frequency, 1.0 corresponds to the first order of the base frequency, and so on. The bottom row lists, for the engine torque T, base magnitudes (BM) for the predetermined orders, respectively, at which to output the one of the predetermined engine sounds 224.

The lookup table is calibrated, for example, based on engine operation with a predetermined CR achievable via the CR actuators. Different CRs, however, produce different engine sounds and sound having different characteristics. Therefore, based on a CR actuator position 232, the sound control module 208 adjusts one or more of the base magnitudes for the predetermined orders, respectively, of the base frequency for outputting the one of the predetermined engine sounds 224. The CR actuator position 232 may be, for example, measured using a sensor or a target CR actuator position commanded by the ECM 114 for execution by the CR actuator module 138. While the example of the CR actuator position 232 is discussed herein, (actual) CR achieved by the CR actuators may be used.

Based on the CR actuator position 232, the sound control module 208 may increase one or more of the base magnitudes for the one of the predetermined engine sounds 224 at one or more of the predetermined orders, respectively. Additionally or alternatively, based on the CR actuator position 232, the sound control module 208 may decrease one or more of the base magnitudes for the one of the predetermined engine sounds 224 at one or more of the predetermined orders, respectively. Additionally or alternatively, based on the CR actuator position 232, the sound control module 208 may decrease one or more of the base magnitudes for the one of the predetermined engine sounds 224 at one or more of the predetermined orders, respectively, to zero. The one of the predetermined engine sounds 224 will not be output at the predetermined order when the magnitude for the predetermined order is set to zero.

The sound control module 208 may additionally adjust one or more of the base magnitudes based on a driver selected mode 236. At a given time, the driver selected mode 236 may be, for example, one of sport, economy, or another suitable mode. While the examples of sport and economy are provided, additional driver selected modes may be possible and different names may be used.

Based on the CR actuator position 232, a first adjustment module 240 determines magnitude adjustments 244 for the predetermined orders, respectively, of the base frequency at which to output the one of the predetermined engine sounds 224. For example, the first adjustment module 240 may determine the magnitude adjustments 244 using a lookup table including sets of magnitude adjustments for the predetermined orders indexed by CR actuator position. An example of one row of such a lookup table for one CR actuator position is provided below merely as an illustrative aid.

| CR Actuator Positon | O→ | | | | | | | | | | | |
|---|---|---|---|---|---|---|---|---|---|---|---|---|
| ↓ | 0.5 | 1.0 | 1.5 | 2.0 | 2.5 | 3.0 | 3.5 | 4.0 | 4.5 | 5.0 | 5.5 | . . . |
| | MA 0.5 | MA 1 | MA1.5 | MA2 | MA2.5 | MA3 | MA3.5 | MA4 | MA4.5 | MA5 | MA5.5 | . . . |

The top row lists predetermined orders (O) of the base frequency (e.g., the predetermined fundamental frequency of the engine 102, a frequency corresponding to the engine speed 212, or a frequency not corresponding to the engine speed 212). For example, 0.5 corresponds to the 0.5th order of the base frequency, 1.0 corresponds to the first order of the base frequency, and so on. The bottom row lists, for the CR actuator position 232, magnitude adjustments (MA) for adjusting the base magnitudes of the predetermined orders, respectively, at which to output the one of the predetermined engine sounds 224.

In the passenger cabin, sound and vibration produced by the engine 102 and mixes with sound and vibration produced by the speakers 204. Because the engine 102 produces different sound and vibration (e.g., different magnitudes and different frequencies) with different CR actuator positions, the magnitude adjustments are calibrated to provide consistent sound and vibration (e.g., at least at only the same frequencies) within the passenger cabin across all possible CR actuator positions. In other words, the sound and vibration experienced during operation with a first CR actuator position and a first set of magnitude adjustments is consistent with (e.g., includes sound at only the same frequencies as) sound and vibration experienced during operation with a second CR actuator position and a second set of magnitude adjustments.

As another example, the first adjustment module 240 may select a set of predetermined magnitude adjustments for use as the magnitude adjustments 244 based on a comparison of the CR actuator position 232 with one or more predetermined CR actuator positions. For example, the first adjustment module 240 may set the magnitude adjustments 244 to a first predetermined set of magnitude adjustments when the CR actuator position 232 is less than a predetermined CR actuator position. The first adjustment module 240 may set the magnitude adjustments 244 to a second predetermined set of magnitude adjustments when the CR actuator position 232 is greater than or equal to the predetermined CR actuator position. While the example of one predetermined CR actuator position is provided, more than one predetermined CR actuator position may be used. Generally speaking, the first adjustment module 240 may set the magnitude adjustments 244 to a predetermined set of magnitude adjustments based on whether the CR actuator position 232 is greater than or less than a predetermined CR actuator position or within a predetermined range defined by two predetermined CR actuator positions.

As discussed above, the sound control module 208 determines the base magnitudes for the respective predetermined orders of the base frequency based on the engine torque 216. The sound control module 208 adjusts the base magnitudes for the predetermined orders based on the magnitude adjustments for the predetermined orders, respectively.

For example, the sound control module 208 may set adjusted magnitudes for the predetermined orders based on or equal to the base magnitudes plus the magnitude adjustments, respectively. As an example, the sound control module 208 may set the adjusted magnitude for the 0.5th order of the base frequency based on or equal to the base magnitude determined for the 0.5th order of the base frequency (based on the engine torque 216) plus the magnitude adjustment determined for the 0.5th order of the base frequency (based on the CR actuator position 232). This is performed similarly to determine the adjusted magnitude for each of the predetermined orders. In various implementations, subtraction, multiplication, or another function may be used. The sound control module 208 includes the adjusted magnitudes for the predetermined orders, respectively, in the characteristics 220.

As stated above, the sound control module 208 may additionally adjust one or more of the base magnitudes based on the driver selected mode 236. For example, a second adjustment module 248 may select a set of predetermined magnitude adjustments for use as second magnitude adjustments 252 based on the driver selected mode 236. For example, the second adjustment module 248 may set the second magnitude adjustments 252 to a first predetermined set of magnitude adjustments when the driver selected mode 236 is the sport mode. The second adjustment module 248 may set the second magnitude adjustments 252 to a second predetermined set of magnitude adjustments when the driver selected mode 236 is the eco mode. The second adjustment module 248 may set the second magnitude adjustments 252 to another predetermined set of magnitude adjustments when the driver selected mode 236 is another mode.

The sound control module 208 may adjust the adjusted magnitudes for the predetermined orders based adding the adjusted magnitudes with the second magnitude adjustments, respectively. As an example, the sound control module 208 may set the adjusted magnitude for the 0.5th order of the base frequency based on or equal to the adjusted magnitude determined for the 0.5th order of the base frequency (as discussed above) plus the second magnitude adjustment determined for the 0.5th order of the base frequency (based on the driver selected mode 236). This may be performed similarly to adjust the adjusted magnitude for each of the predetermined orders. In various implementations, subtraction, multiplication, or another function may be used. The sound control module 208 includes the adjusted magnitudes in the characteristics 220. In various implementations, the second adjustment module 248 and adjustment based on the driver selected mode 236 may be omitted.

An audio driver module 280 receives the characteristics 220 and the predetermined engine sound(s) 224. The audio driver module 280 applies power (e.g., from the one or more other batteries) to the speakers 204 to output the one of the predetermined engine sounds 224 at the respective frequencies (corresponding to the predetermined orders of the base frequency) and adjusted magnitudes specified by the sound control module 208 in the characteristics 220. As discussed above, the adjusted magnitudes for the predetermined orders, respectively, of the base frequency are set based on the CR actuator position 232.

Adjusting the magnitudes of the sound output based on the CR actuator position 232 provides for consistent sound and vibration within the passenger cabin despite differences in sound and vibration due to changes in the CR actuator position 232. This may improve the experience of a user.

Figure 3:
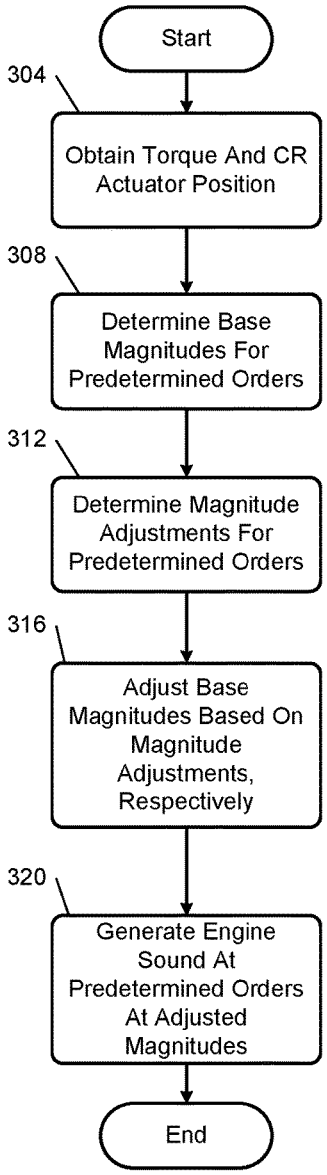
FIG. 3 is a flowchart depicting an example method of outputting engine sound based on compression ratio.

FIG. 3 is a flowchart depicting an example method of outputting predetermined engine sound based on CR actuator position. Control may begin with 304 where the audio control module 200 obtains the engine torque 216 and the CR actuator position 232. The audio control module 200 may receive the engine torque 216 and the CR actuator position 232 from the ECM 114 in various implementations.

At 308, the sound control module 208 determines the base magnitudes for the predetermined orders of the base frequency at which to output one of the predetermined engine sounds 224 based on the engine torque 216. The base frequency may be, for example, the predetermined fundamental frequency of the engine 102, a frequency corresponding to the engine speed 212, or a frequency not corresponding to the engine speed 212. One base magnitude is determined for each of the predetermined orders.

At 312, the first adjustment module 240 determines the magnitude adjustments 244 for the predetermined orders, respectively, based on the CR actuator position 232. At 316, the sound control module 208 adjusts the base magnitudes for the predetermined orders based on the magnitude adjustments for the predetermined orders, respectively. For example, the sound control module 208 may add the base magnitudes for the predetermined orders with the magnitude adjustments for the predetermined orders, respectively. As an example, the sound control module 208 may set the adjusted magnitude for the 0.5th order of the base frequency based on or equal to the base magnitude determined for the 0.5th order of the base frequency plus the magnitude adjustment determined for the 0.5th order of the base frequency.

At 320, the audio driver module 280 applies electrical power to the speakers 204 to output the one of the predetermined engine sounds 224 at the frequencies (i.e., the frequencies of the predetermined orders of the base frequency) and the adjusted magnitudes for the predetermined orders, respectively. The one of the predetermined engine sounds 224 is therefore output via the speakers 204 at the frequencies and adjusted magnitudes, respectively.

Figure 4:
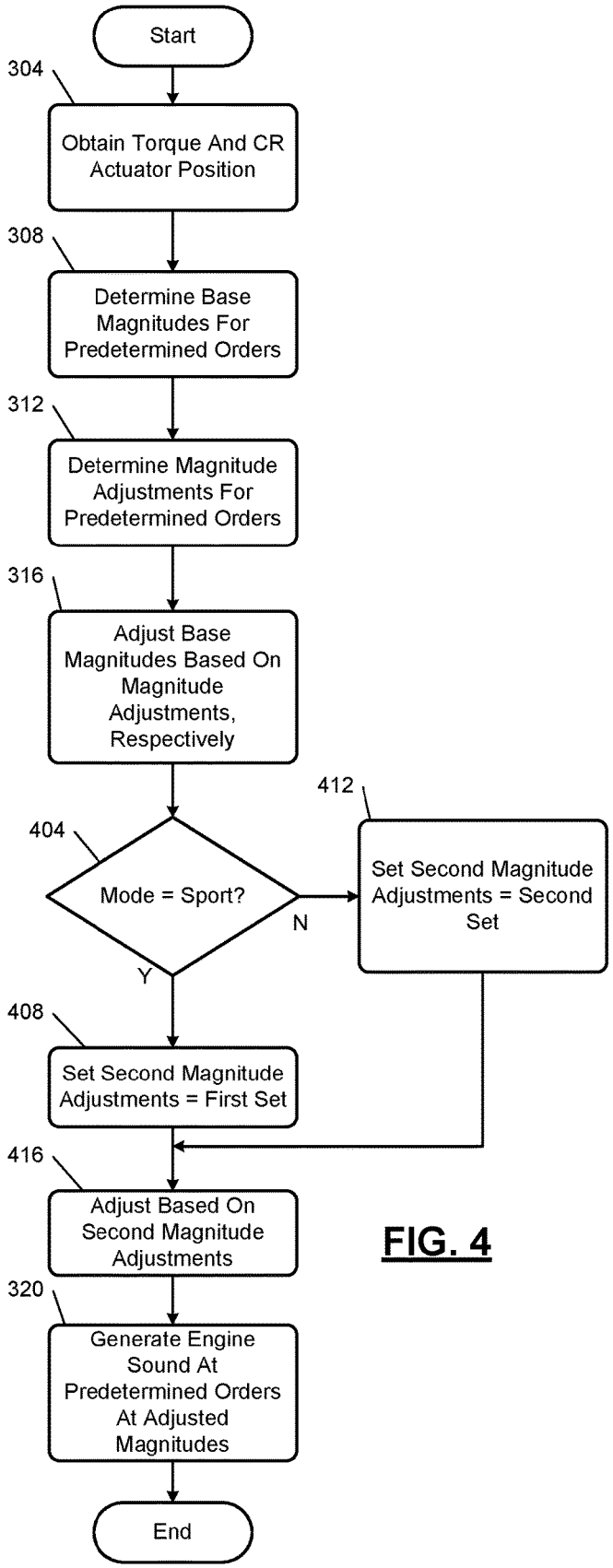
FIG. 4 is a flowchart depicting an example method of outputting engine sound based on compression ratio and driver selected mode of operation.

FIG. 4 is a flowchart depicting an example method of outputting predetermined engine sound based on CR actuator position and driver selected mode. Control begins with 304-316, as described above. At 404, the second adjustment module 248 may determine whether the driver selected mode 236 is the sport mode. If 404 is true, the second adjustment module 248 may set the second magnitude adjustments 252 for the predetermined orders to a first predetermined set of magnitude adjustments for the predetermined orders at 408, and control may continue with 416. If 404 is true, the second adjustment module 248 may set the second magnitude adjustments 252 for the predetermined orders to a second predetermined set of magnitude adjustments for the predetermined orders at 412, and control may continue with 416.

At 416, the sound control module 208 adjusts the adjusted magnitudes for the predetermined orders based on the second magnitude adjustments 252 for the predetermined orders, respectively. For example, the sound control module 208 may add the adjusted magnitudes for the predetermined orders with the second magnitude adjustments for the predetermined orders, respectively. As an example, the sound control module 208 may set the adjusted magnitude for the 0.5th order of the base frequency based on or equal to the adjusted magnitude determined for the 0.5th order of the base frequency (from 316) plus the second magnitude adjustment determined for the 0.5th order of the base frequency. At 320, the audio driver module 280 applies electrical power to the speakers 204 to output the one of the predetermined engine sounds 224 at the frequencies (i.e., the frequencies of the predetermined orders of the base frequency) and the adjusted magnitudes for the predetermined orders, respectively. The one of the predetermined engine sounds 224 is therefore output via the speakers 204 at the frequencies and adjusted magnitudes, respectively.

While the examples of FIGS. 3 and 4 are shown as ending, FIGS. 3 and 4 are illustrative of one control loop and control loops may be initiated at a predetermined rate. Also, FIGS. 3 and 4 may be performed for more than one of the predetermined engine sounds 224 to be output and/or for predetermined orders of more than one frequency.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An audio control system of a vehicle, comprising:

a sound control module configured to determine N magnitudes for outputting a predetermined engine sound at N predetermined harmonics of a base frequency, respectively, wherein N is an integer greater than one; and an adjustment module configured to determine N magnitude adjustments for the N predetermined harmonics, respectively, based on a position of a compression ratio (CR) actuator configured to vary a CR of an engine;

wherein the sound control module is further configured to determine N adjusted magnitudes for the N predetermined harmonics based on:

the N magnitudes for the N predetermined harmonics, respectively; and the N magnitude adjustments for the N predetermined harmonics, respectively; and an audio driver module configured to apply power to at least one speaker of the vehicle and output the predetermined engine sound based on the N adjusted magnitudes at N frequencies, respectively, corresponding to the N predetermined harmonics of the base frequency.

2. The audio control system of claim 1 wherein the sound control module is configured to:

based on the position of the CR actuator being a first predetermined position, set the N magnitude adjustments for the N predetermined harmonics to a first set of N predetermined magnitude adjustments for the N predetermined harmonics, the first set being associated with the first predetermined position; and based on the position of the CR actuator being a second predetermined position, set the N magnitude adjustments for the N predetermined harmonics to a second set of N predetermined magnitude adjustments for the N predetermined harmonics, the second set being associated with the second predetermined position, wherein the first predetermined position is different than the second predetermined position.

3. The audio control system of claim 1 wherein the sound control module is configured to:

based on the position of the CR actuator being less than a predetermined position, set the N magnitude adjustments for the N predetermined harmonics to a first set of N predetermined magnitude adjustments for the N predetermined harmonics; and based on the position of the CR actuator being greater than the predetermined position, set the N magnitude adjustments for the N predetermined harmonics to a second set of N predetermined magnitude adjustments for N predetermined harmonics.

4. The audio control system of claim 3 wherein at least one of:

the first set of N predetermined magnitude adjustments includes a magnitude adjustment for at least one predetermined half order harmonic of the base frequency; and the second set of N predetermined magnitude adjustments includes a magnitude adjustment for at least one predetermined half order harmonic of the base frequency.

5. A vehicle system comprising:

the audio control system of claim 1; and the compression ratio (CR) actuator, wherein the CR actuator is configured to vary at least one of:

a top most position of a piston within a cylinder; and a bottom most position of the piston within the cylinder.

6. The audio control system of claim 1 wherein the sound control module is configured to determine the N magnitudes for the N predetermined harmonics, respectively, based on an engine torque output.

7. The audio control system of claim 6 wherein the sound control module is configured to determine the N magnitudes for the N predetermined harmonics, respectively, based on the engine torque output using a lookup table, wherein the lookup table includes sets of magnitudes for the N predetermined harmonics, respectively, indexed by engine torque output.

8. The audio control system of claim 1 wherein the sound control module is configured to set the N adjusted magnitudes for the N predetermined harmonics based on sums of:

the N magnitudes for the N predetermined harmonics, respectively; and the N magnitude adjustments for the N predetermined harmonics, respectively.

9. The audio control system of claim 1 wherein the sound control module is configured to set the N adjusted magnitudes for the N predetermined harmonics based on mathematical products of:

the N magnitudes for the N predetermined harmonics, respectively; and the N magnitude adjustments for the N predetermined harmonics, respectively.

10. The audio control system of claim 1 wherein the N predetermined harmonics include at least one predetermined half order harmonic of the base frequency.

11. The audio control system of claim 1 wherein the base frequency is a predetermined fundamental frequency of the engine.

12. The audio control system of claim 1 wherein the base frequency corresponds to a rotational speed of the engine.

13. The audio control system of claim 1 wherein the base frequency does not correspond to a rotational speed of the engine and is not a predetermined fundamental frequency of the engine.

14. The audio control system of claim 1 further comprising:

a second adjustment module configured to determine N second magnitude adjustments for the N predetermined harmonics, respectively, based on a driver selected mode of operation;

wherein the sound control module is configured to determine the N adjusted magnitudes for the N predetermined harmonics based on:

the N magnitudes for the N predetermined harmonics, respectively;

the N second magnitudes for the N predetermined harmonics, respectively; and the N magnitude adjustments for the N predetermined harmonics, respectively.

15. The audio control system of claim 14 wherein the second adjustment module is configured to:

when the driver selected mode is a first mode, set the N second magnitude adjustments for the N predetermined harmonics to a first set of N predetermined second magnitude adjustments for the N predetermined harmonics; and when the driver selected mode is a second mode, set the N second magnitude adjustments for the N predetermined harmonics to a second set of N second predetermined magnitude adjustments for the N predetermined harmonics.

16. An audio control method for a vehicle, comprising:

determining N magnitudes for outputting a predetermined engine sound at N predetermined harmonics of a base frequency, respectively, wherein N is an integer greater than one;

determining N magnitude adjustments for the N predetermined harmonics, respectively, based on a position of a compression ratio (CR) actuator configured to vary a CR of an engine;

determining N adjusted magnitudes for the N predetermined harmonics based on:

the N magnitudes for the N predetermined harmonics, respectively; and the N magnitude adjustments for the N predetermined harmonics, respectively; and applying power to at least one speaker of the vehicle and outputting the predetermined engine sound based on the N adjusted magnitudes at N frequencies, respectively, corresponding to the N predetermined harmonics of the base frequency.

17. The audio control method of claim 16 wherein determining N magnitude adjustments for the N predetermined harmonics includes:

based on the position of the CR actuator being a first predetermined position, setting the N magnitude adjustments for the N predetermined harmonics to a first set of N predetermined magnitude adjustments for the N predetermined harmonics, the first set being associated with the first predetermined position; and based on the position of the CR actuator being a second predetermined position, setting the N magnitude adjustments for the N predetermined harmonics to a second set of N predetermined magnitude adjustments for the N predetermined harmonics, the second set being associated with the second predetermined position, wherein the first predetermined position is different than the second predetermined position.

18. The audio control method of claim 16 wherein determining N magnitude adjustments for the N predetermined harmonics includes:

based on the position of the CR actuator being less than a predetermined position, setting the N magnitude adjustments for the N predetermined harmonics to a first set of N predetermined magnitude adjustments for the N predetermined harmonics; and based on the position of the CR actuator being greater than the predetermined position, setting the N magnitude adjustments for the N predetermined harmonics to a second set of N predetermined magnitude adjustments for N predetermined harmonics.

19. The audio control method of claim 18 wherein at least one of:

the first set of N predetermined magnitude adjustments includes a magnitude adjustment for at least one predetermined half order harmonic of the base frequency; and the second set of N predetermined magnitude adjustments includes a magnitude adjustment for at least one predetermined half order harmonic of the base frequency.

20. The audio control method of claim 16 further comprising:

adjusting the position of the CR actuator, thereby varying at least one of:

a top most position of a piston within a cylinder; and a bottom most position of the piston within the cylinder.

* * * * *